US005625395A

United States Patent [19]

Imai

[11] Patent Number: 5,625,395

[45] Date of Patent: Apr. 29, 1997

[54] DRIVING DEVICE FOR AN INK JET PRINT HEAD

[75] Inventor: Koji Imai, Nagoya, Japan

[73] Assignee: Brother Kogyo Kabushiki Kaisha, Aichi-ken, Japan

[21] Appl. No.: 329,454

[22] Filed: Oct. 26, 1994

[30] Foreign Application Priority Data

Oct. 27, 1993 [JP] Japan ..... 5-268562

[51] Int. Cl.[6] ..... B41J 2/045

[52] U.S. Cl. ..... 347/71; 347/69

[58] Field of Search ..... 347/9, 12, 68, 347/69, 70, 71, 132, 211, 237; 310/317

[56] References Cited

U.S. PATENT DOCUMENTS 4,367,480 1/1983 Kotoh ..... 347/71
5,252,994 10/1993 Narita et al. ..... 347/71

FOREIGN PATENT DOCUMENTS 4-182138 6/1992 Japan .

OTHER PUBLICATIONS

Patent Abstracts of Japan, JP 4–182138 (Seiko Epson Corp.), Jun. 29, 1992.

*Primary Examiner*—Benjamin R. Fuller
*Assistant Examiner*—L. Anderson
*Attorney, Agent, or Firm*—Oliff & Berridge

[57] ABSTRACT

A dual ink jet head has an actuator formed from a piezoelectric material that has side A and side B formed with a plurality of ink channels in total. To eject ink droplets from the nozzles in both side A and side B of the actuator using a single power source, electrode pairs for selected ink channels in side A are connected to the single power source and the remaining electrode pairs for non-selected ink channels in side A are disconnected from the single power source, and electrode pairs for selected ink channels in side B are disconnected from the single power source and the remaining electrode pairs for non-selected ink channels in side B are connected to the single power source. By so driving the actuator, ink droplets are ejected from the nozzles corresponding to the selected electrode pairs in both side A and side B.

18 Claims, 9 Drawing Sheets

A

B

TRANSFERRING SERIAL DATA

▨: INVERTED BIT IN CONTROL SECTION 200

DRIVING DEVICE FOR AN INK JET PRINT HEAD

BACKGROUND OF THE INVENTION

1. Field of the Invention

The present invention relates to a device for driving an ink jet head to eject ink from the ink jet head.

2. Description of the Prior Art

A conventional ink jet head and a driver for driving the head are constructed as will be described below.

FIG. 1 shows structure of an ink jet head 1. The ink jet head 1 includes a piezoelectric ceramic plate 2, a cover plate 10, a nozzle plate 14, and a substrate 41.

The piezoelectric ceramic plate 2 is polarized in the direction indicated by arrow 5. A certain number of grooves 3 are cut into the piezoelectric ceramic plate 2 in a direction parallel to the direction of polarization. The depth of the grooves 3 becomes gradually shallower with increasing closeness to the end 15 of the piezoelectric ceramic plate 2. Shallow grooves 7 are formed adjacent to the end 15. Metal electrodes 8 are formed to the upper half of both side surfaces of each groove 3 using sputtering or some other technique. Metal electrodes 9 are formed to the side surfaces and the floor of each shallow groove 7. The metal electrodes 9 are for providing electrical connection between the metal electrodes 8 formed at either side of each groove 3.

The cover plate 10 is formed from a ceramic or resin material. An ink introduction port 16 and a manifold 18 are formed in the cover plate 10 by cutting or grinding. Using an epoxy type adhesive 20 (refer to FIG. 3), the surface of the piezoelectric ceramic plate 2 with the grooves 3 formed therein is adhered to the surface of the cover plate 10 with the manifold 18 formed therein. As a result, the tops of the grooves 3 are covered to produce ink chambers 4 (refer to FIG. 3). The ink chambers 4 are a plurality of ink channels formed at a uniform pitch across the width of the head 1. Ink fills all of the ink chambers 4*a*–4*h*, collectively denoted as ink chambers 4.

A nozzle plate 14 formed from plastic is provided with nozzles 12 in the same pitch as the pitch of the ink chambers 4. The nozzle plate 14 is adhered to the ends of the piezoelectric ceramic plate 2 and the cover plate 10 so that each nozzle 12 is aligned with an ink chamber 4.

A substrate 41 is adhered using an epoxy type adhesive to the side of the piezoelectric ceramic plate 2 opposite the side with the grooves 3 formed therein. Conductor layer patterns 42 are formed to the substrate 41 at positions corresponding to the positions of the ink chambers 4. Each conductor layer pattern 42 is connected to a corresponding metal electrode 9 at the floor of each shallow groove 7 by conductor wires 43 using well-known wire bonding techniques.

FIG. 2 shows connection of the ink jet head 1 to a driver 50 for driving the ink jet head 11 according to a print signal.

Each conductor layer pattern 42 formed to the substrate 41 is individually connected to the driver 50. Print timing is continuously supplied to the driver 50 in an ejection signal 52. Data on ink chambers 4 from which ink is to be ejected is transmitted in a print signal 53. The driver 50 applies a voltage EV to metal electrodes 8 of ink chambers 4 from which ink is to be ejected according to data transmitted in the print signal 53 at timing based on the ejection signal 52. The driver 50 applies a 0 V to metal electrodes 8 of ink chambers 4 from which ink is not to be ejected.

Next, an description of operation of the ink jet head 1 will be provided while referring to FIGS. 3 and 4.

Based on desired data, the driver 50 makes a determination that ink is to be ejected from ink chamber 4*b* of the ink jet head 1. The driver 50 therefore applies a positive drive voltage EV to metal electrodes 8*e* and 8*f* and a 0 V voltage to metal electrodes 8*d* and 8*g*. As a result, drive electric fields are formed in side walls 6*b* and 6*c* in directions indicated by arrows 13*b* and 13*c* respectively. It should be noted that directions indicated by arrows 13*b* and 13*c* are perpendicular to the direction of polarization 5. Side walls 6*b* and 6*c* are rapidly deformed by the piezoelectric shear effect. Therefore, the volume of the ink chamber 4*b* rapidly decreases and the ink pressure rapidly increases, causing an ink droplet to be ejected from the nozzle 12 that is in fluid communication with the ink chamber 4*b*.

In order to increase the print density of the ink jet head 1, it has been proposed in Japanese Patent Application Kokai No. HEI-4-182138 to construct a dual head with two rows of ink nozzles. The ink nozzles in each row are arranged in a staggered pattern. The piezoelectric ceramic plate of the dual head is polarized in a single direction. A plurality of grooves are cut into both surfaces of the piezoelectric ceramic plate at an equal pitch. However, grooves in one surface of the piezoelectric ceramic plate are cut shifted one half the distance of the pitch with respect to grooves cut in the other surface of the piezoelectric ceramic plate. Metal electrodes are formed to the side surfaces of the side walls that define the grooves. Because each nozzle is formed in the nozzle plate at a position corresponding to the position of a nozzle, the nozzles are also staggered. By ejecting ink droplets while transporting the ink jet head in a scanning direction, printing can be accomplished at twice the density of the above-described ink jet heat 1.

However, in the dual head described above, because the overall piezoelectric ceramic plate is polarized in one direction, the relative polarization directions of side walls defining ink chambers on opposite surfaces of the piezoelectric ceramic plate are opposite. Therefore, to eject ink in the same manner by deformation of side walls of opposite surfaces, for example, one surface must be energized with a positive voltage and the other surface must be energized with a negative voltage. In this way, both a positive and a negative power source are necessary. The drive circuit is also complicated. Both of these problems increase production costs.

SUMMARY OF THE INVENTION

In order to overcome the above described problems, it is an objective of the present invention to provide a dual ink jet head assembly which can print with a single power source.

In order to attain the above-described objectives, there is provided according to the present invention an ink jet head assembly including an actuator formed from a piezoelectric material polarized in a direction. The actuator has a first surface, a second surface opposite the first surface, and a third surface perpendicular to both the first surface and the second surface. A plurality of partition walls are formed at equi-interval in each of the first surface and the second surface wherein each of the plurality of partition walls has two side surfaces opposite to each other and a top surface. A plurality of grooves are formed in each of the first surface and the second surface wherein each of the plurality of grooves is defined by two adjacent partition walls. There are provided a plurality of first electrode pairs provided in one-to-one correspondence to the plurality of partition walls in the first surface, two electrodes of each first electrode pair being attached respectively to two side surfaces of each of the plurality of partition walls, and a plurality of second electrode pairs provided in one-to-one correspondence to the plurality of partition walls in the second surface, two electrodes of each second electrode pair being attached respectively to two side surfaces of each of the plurality of partition walls. There is further provided a first cover plate attached to the top surfaces of the partition walls in the first surface and second cover plate attached to the top surface of the partition walls in the second surface, an ink channel being defined by each of the first cover plate and the second cover plate and each of the plurality of grooves in each of the first surface and the second surface, ink channels being filled with ink. A nozzle plate attached to the third surface of the actuator, the nozzle plate being formed with a plurality of nozzles in positions corresponding to the ink channels. A driving device is provided which includes a single power source, a plurality of first connecting means provided in one-to-one correspondence to the plurality of first electrode pairs, a plurality of second connecting means provided in one-to-one correspondence to the plurality of second electrode pairs, and control means. The control means controls the plurality of first connecting means to connect the single power source to selected ones of the electrode pairs in the first surface and to disconnect the single power source from non-selected electrode pairs in the first surface, and for controlling the plurality of second connecting means to disconnect the single power source from selected ones of the electrode pairs in the second surface and to connect the single power source to non-selected electrode pairs in the second surface, so that selected partition walls corresponding to the selected electrode pairs in both the first surface and the second surface deform, thereby ejecting an ink droplet from each of nozzles corresponding to the selected partition walls.

Preferably, the non-selected electrode pairs in both the first surface and the second surface are connected to ground.

BRIEF DESCRIPTION OF THE DRAWINGS

The above and other objects, features and advantages of the present invention will become more apparent from the following description when taken in conjunction with the accompanying drawings in which preferred embodiments of the present invention are shown by way of illustrative example.

DETAILED DESCRIPTION OF THE PREFERRED EMBODIMENTS

Preferred embodiments of the present invention will be described with reference to the accompanying drawings. Like components and parts will be referred to by the same numbering to avoid duplication of description.

Figure 9:
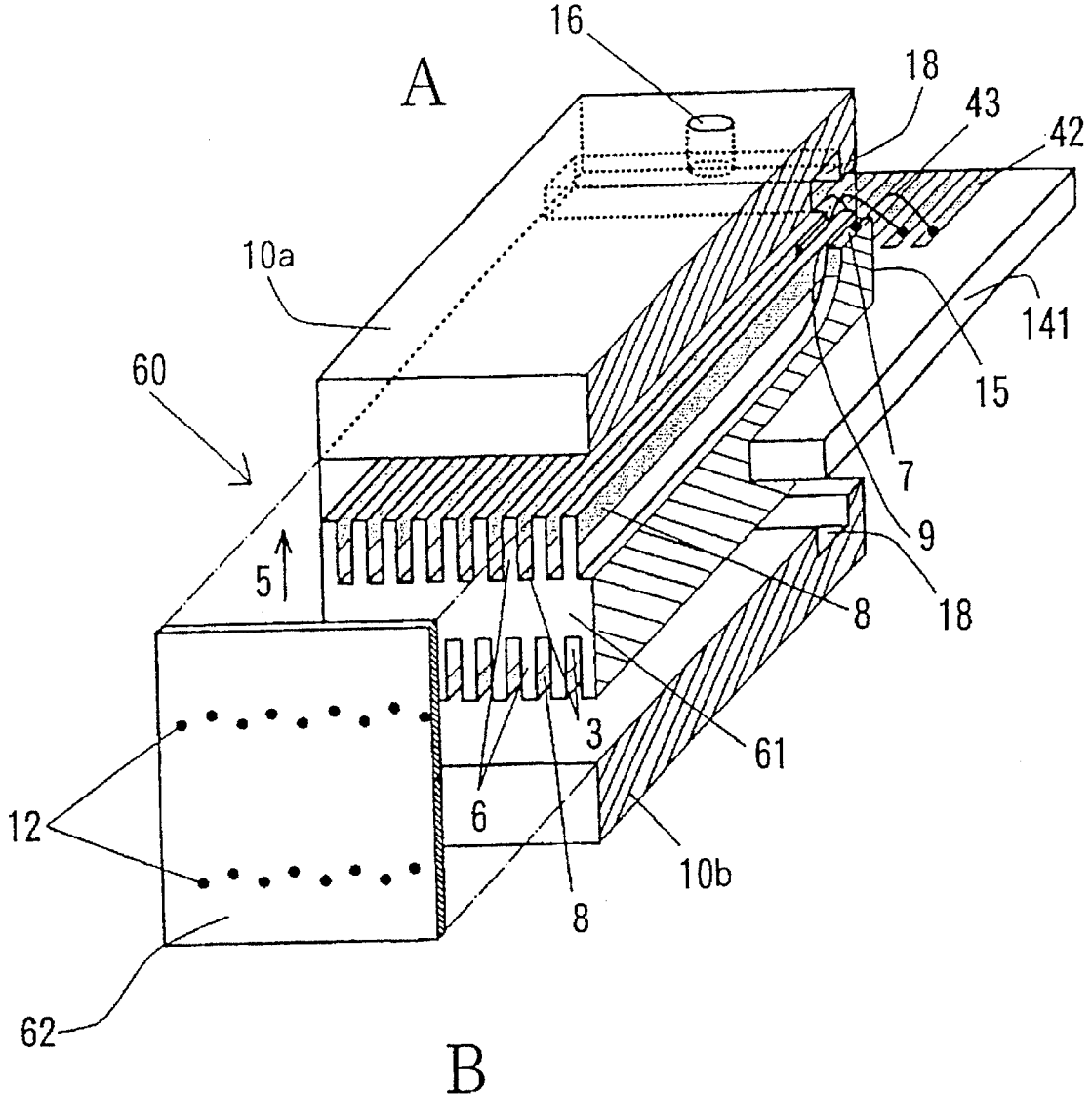
FIG. 9 is an explanatory diagram indicating the ink jet head according to the embodiment.

FIG. 9 is a perspective view of an ink jet head 60. The ink jet head 60 includes a piezoelectric ceramic plate 61, cover plates 10*a* and 10*b*, a nozzle plate 62, and a substrate 141.

The piezoelectric ceramic plate 61 is polarized in the direction indicated by arrow 5. Grooves 3 are formed in both surfaces of the piezoelectric ceramic plate 61 by cutting in a direction parallel to the direction of polarization. The upper (as viewed in FIG. 9) surface of the piezoelectric ceramic plate 61 will be referred to as side A and the lower surface will be referred to as side B hereinafter. The side A grooves 3 are formed at positions shifted with respect to positions of the side B grooves 3 one half the distance of the pitch. A total number n of grooves 3 are formed on sides A and B. The grooves 3 become increasingly shallow near the end 15 of the piezoelectric ceramic plate 61. Shallow grooves 7 are formed adjacent to end 15. Metal electrodes 8 are formed by sputtering or other technique to cover the upper half of both inner sides of the grooves 3. Metal electrodes 9 are formed to the side surfaces and the floor of each shallow groove 7 so as to electrically connect the metal electrodes 8 formed to either side surface of each groove 3.

The cover plates 10*a* and 10*b* are formed from a ceramic or plastic material. An ink introduction port 16 and a manifold 18 are formed in each cover plate 10*a* and 10*b* by cutting or grinding. The surface of each cover plate 10*a* and 10*b* with a manifold 18 formed therein is adhered to a surface of the piezoelectric ceramic plate 61 with grooves 3 formed therein using an epoxy type adhesive 20 (refer to FIG. 10). Therefore the grooves 3 are covered at their open surfaces to produce a plurality of ink channels at a uniform pitch in the widthwise direction of the piezoelectric ceramic plate. The ink channels form two rows (an upper row and a lower row) of ink channels in the ink jet head 60.

The nozzle plate 62 is formed from plastic. Nozzles 12 are provided in the nozzle plate 62 in a staggered formation so that each nozzle 12 is at a position that corresponds to the positions of an ink chamber 4. The nozzle plate 62 is adhered to the end of the piezoelectric ceramic plate 61 and the cover plate 10*a* and 10*b*.

Conductor layer patterns 42 are formed on both surfaces of the substrate 141. Each conductor layer pattern 42 is formed at a position that corresponds to the position of an ink chamber 42. By well-known wire bonding techniques, a wire conductor 43 is connected between each conductor layer pattern 42 and the metal electrode 9 at the floor of a corresponding shallow groove 7.

Figure 6:
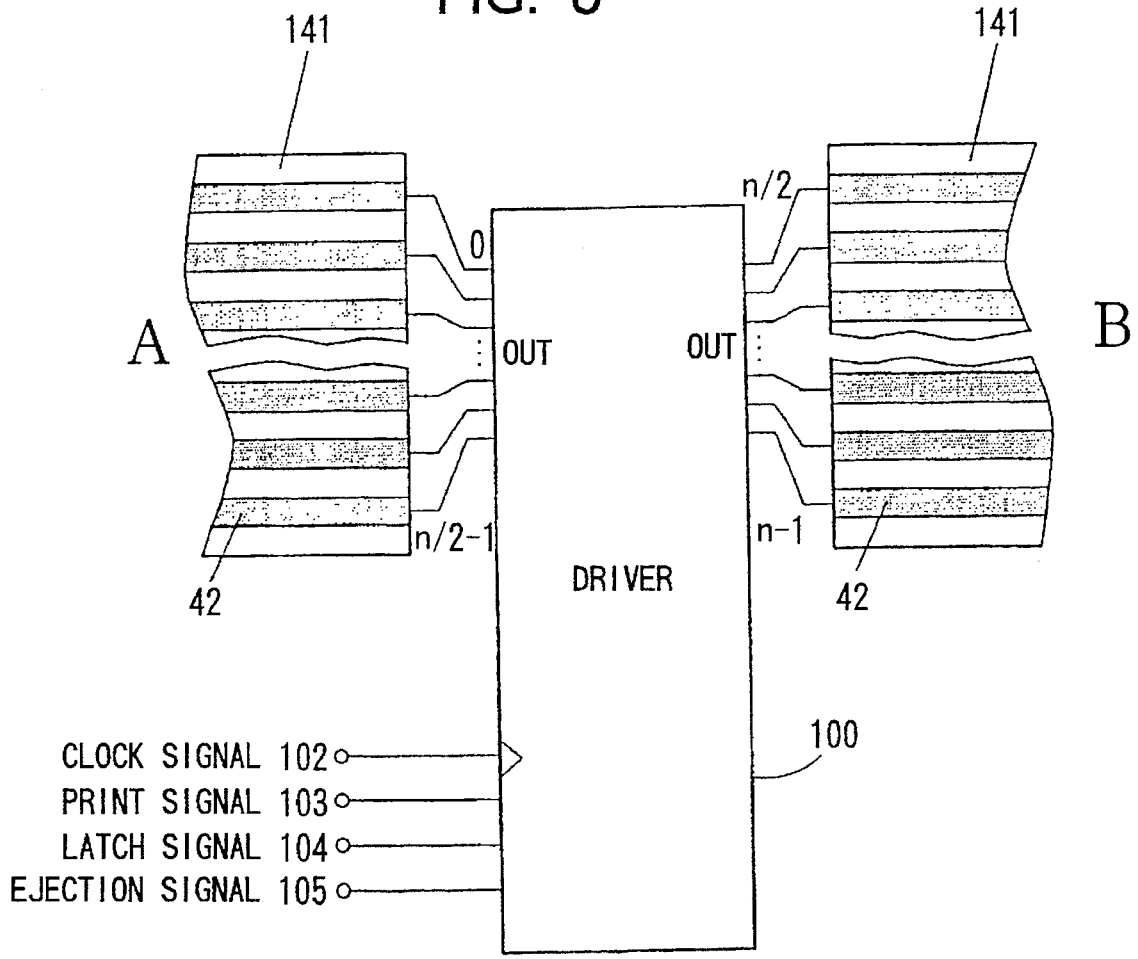
FIG. 6 is an explanatory diagram indicating the area according to the embodiment where the driving device is connected with the ink jet head.

FIG. 6 is a structural diagram showing connections between the ink jet head 60 and a driver 100. To facilitate description, and allow viewing both surfaces of the substrate 141, that is, side A and side B, and their respective conductor layer patterns 42 at the same time, FIG. 6 is drawn as though both surfaces of the substrate 141 are on the same plane. Output OUT of the driver 100 includes channels 0 through n−1 (The letter n represents the total number of nozzles 12 provided to both sides A and B of the ink jet head 60. Because features such as channels and grooves are associated with each of the nozzles 12, these features are also referred to by the letter n, such as "n" channels). Channels 0 through n/2−1 of the output OUT of the driver 100 are connected to corresponding conductor layer patterns 42 for side A. Channels n/2 through n−1 from the output OUT of the driver 100 are connected to conductor layer patterns 42 of side B. A controller (not shown) inputs to the driver 100 a print signal serially transmitted in synchronization with clock signal 102; a latch signal for internally latching data after transmission; and an ejection signal 105 for applying timing of ejections from the nozzles 12.

Figure 1:
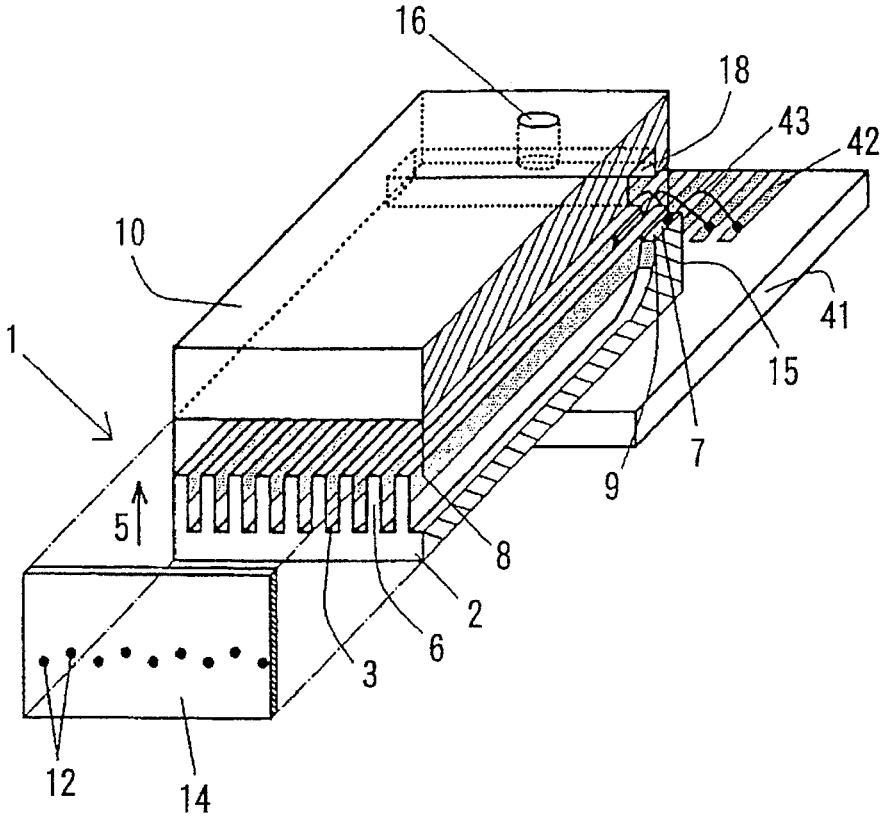
FIG. 1 PRIOR ART
FIG. 1 is a perspective view showing a conventional head.
Figure 2:
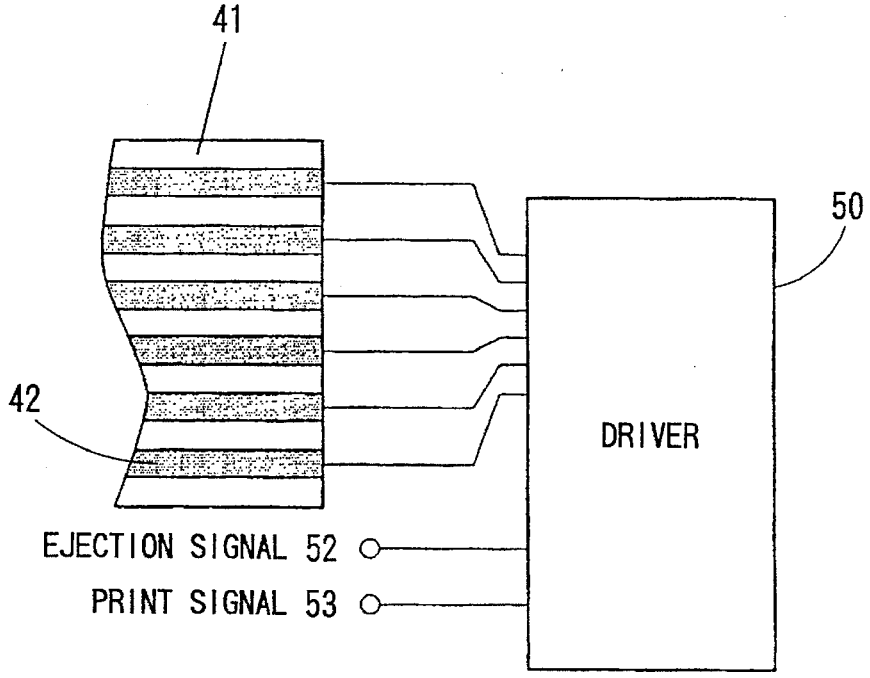
FIG. 2 PRIOR ART
FIG. 2 is an explanatory diagram showing area where the conventional head and a conventional driving device are connected.
Figure 3:
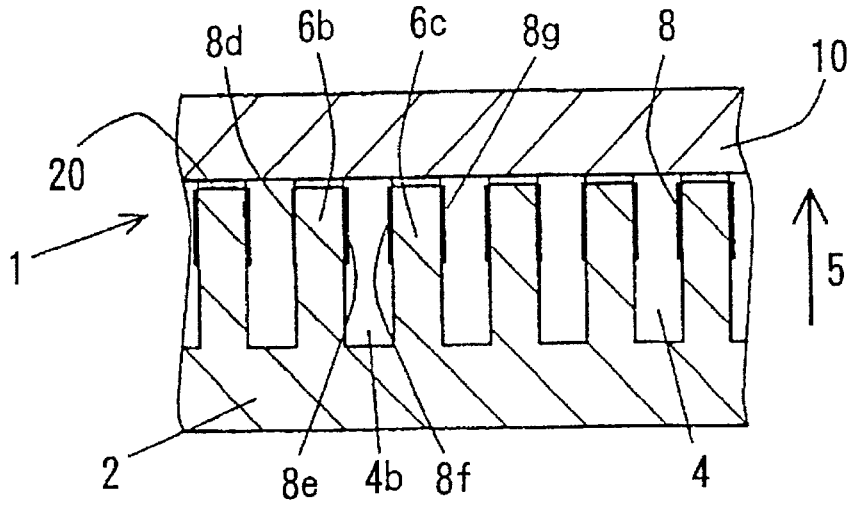
FIG. 3 PRIOR ART
FIG. 3 is a cross-sectional diagram showing the conventional head.
Figure 4:
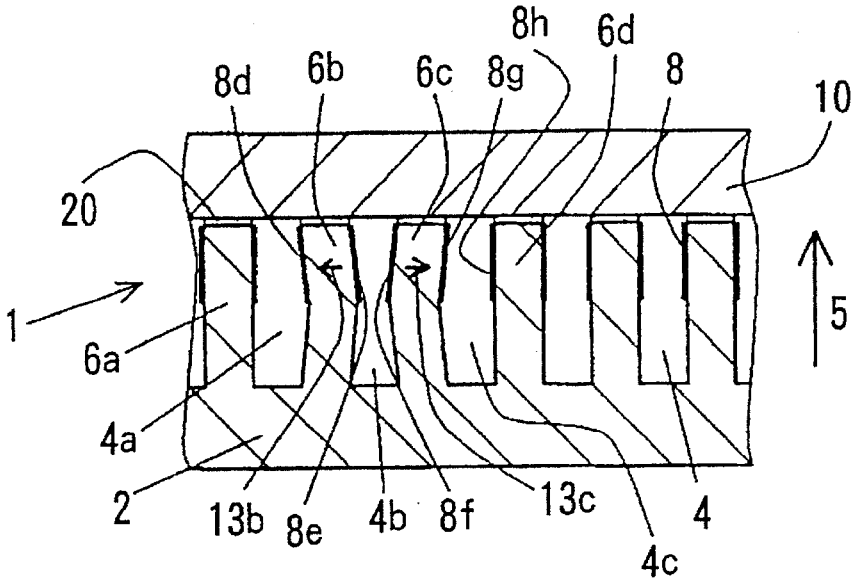
FIG. 4 PRIOR ART
FIG. 4 is an explanatory diagram showing operation of the conventional head.
Figure 5:
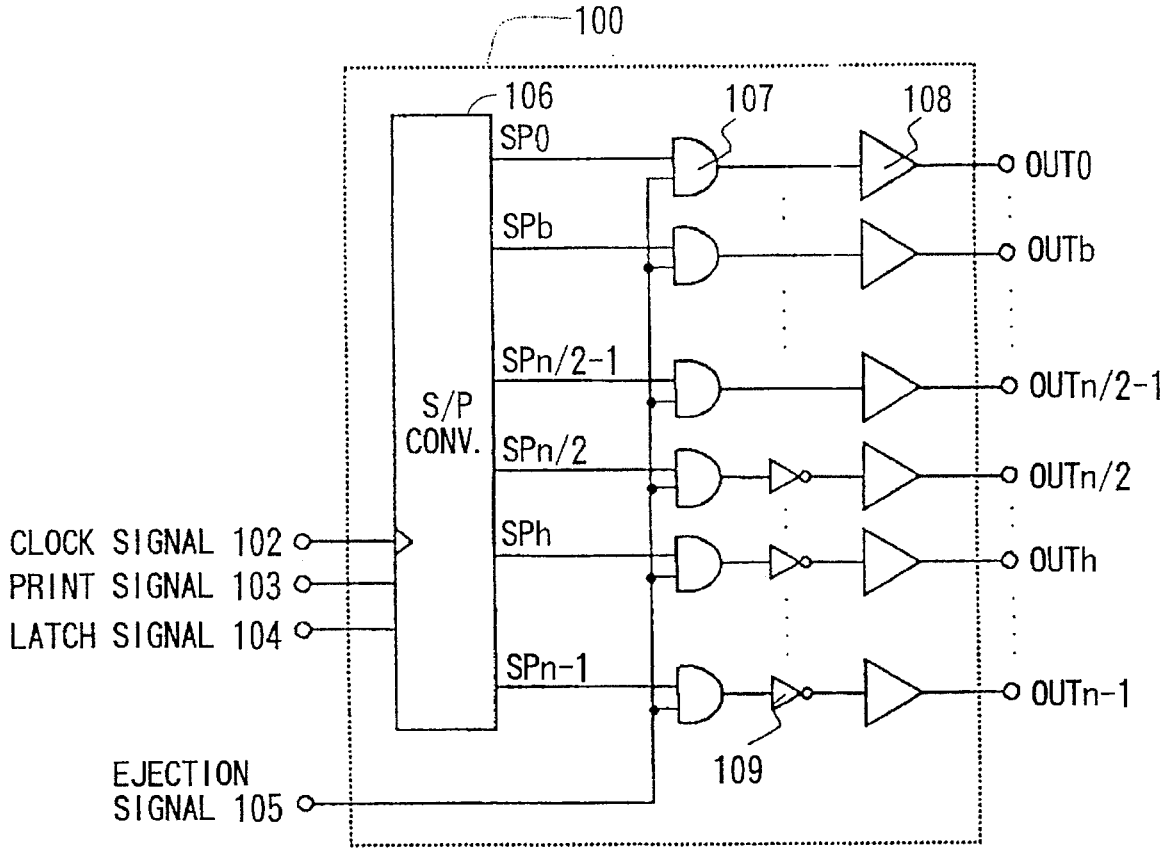
FIG. 5 is a structural diagram of an ink jet head driving device according to an embodiment of the present invention.

As shown in FIG. 5, the internal construction of the driver 100 includes a serial to parallel converter (referred to as S/P converter hereinafter) 106, AND gates 107, buffer AND gates 108, and an n/2 number of NOT gates 109. The S/P converter 106 is for converting the serially transmitted print signal 103 into a parallel signal. One of the n/2 number of NOT gates 109 is provided for channel n/2 and up between each of the buffer AND gates 108 and its corresponding AND gate 107.

The S/P converter 106 takes in the print signal 103 (1 or 0 in this case) in synchronization with the rising edge of the clock signal 102. See FIG. 8. The S/P converter 106 converts the taken-in data into a parallel signal and outputs the parallel signal consecutively from outputs SPO through SPn−1. After data is taken for each of the n number of channels, output SP is latched by enabling (in this case, 1) the latch signal 104.

Each AND gate 107 obtains the logic product of the ejection signal 105 and output SP from the S/P converter 106 over the corresponding channel. The AND gates of channels 0 through n/2−1 then transmit the resultant logic product directly to the buffer AND gate 108 of corresponding channels. The AND gates of channels n/2 through n−1 however transmit the resultant logic product to the buffer AND gate 108 of its corresponding channel via the interposed NOT gate 109, where the logic product is inverted.

Figure 7:
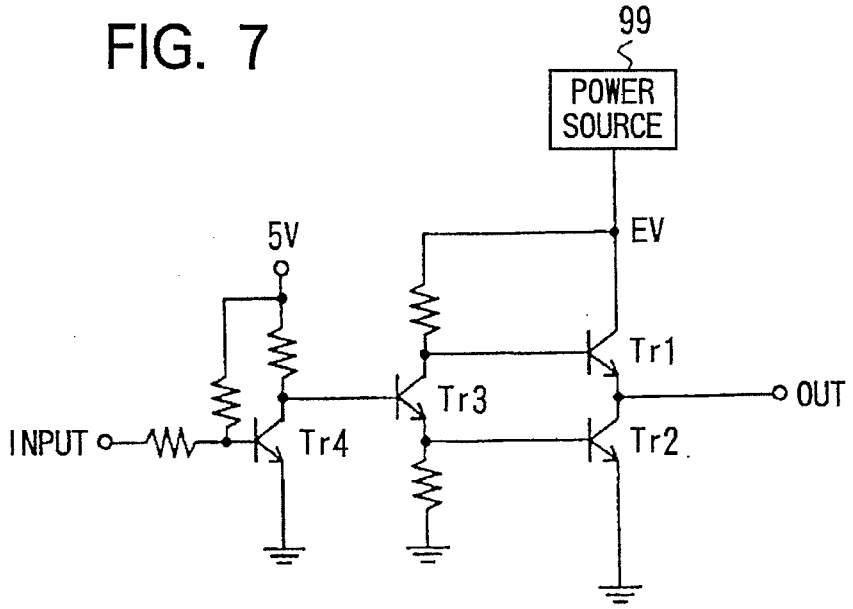
FIG. 7 is a circuit diagram indicating a buffer AND gate of the driving device of the embodiment.

As shown in FIG. 7, the buffer AND gate 108 includes a transistor Tr1, a transistor Tr2, switch transistors Tr3 and Tr4, and a number of resistors. The output OUT is connected to the capacitive load, i.e., the piezoelectric ceramic material of the side wall 6. The transistor Tr1 is for charge and the transistor Tr2 is for discharge at this capacitive load. When the inputted signal is "1" the transistor Tr4 is rendered ON so that the transistor Tr3 is rendered OFF. Because the transistor Tr3 is OFF, the charge transistor Tr1 is rendered ON, and the discharge transistor Tr2 is rendered OFF. As a result, the voltage EV generated from the power source 99 is outputted from the output OUT so that the load is charged. When the inputted signal is "0" the transistor Tr4 is rendered OFF so that the transistor Tr3 is rendered ON. The ON transistor Tr3 renders the charge transistor Tr1 OFF and the discharge transistor Tr2 ON. As a result, the load or the electric charge is discharged to the earth via transistor Tr2.

Figure 8:
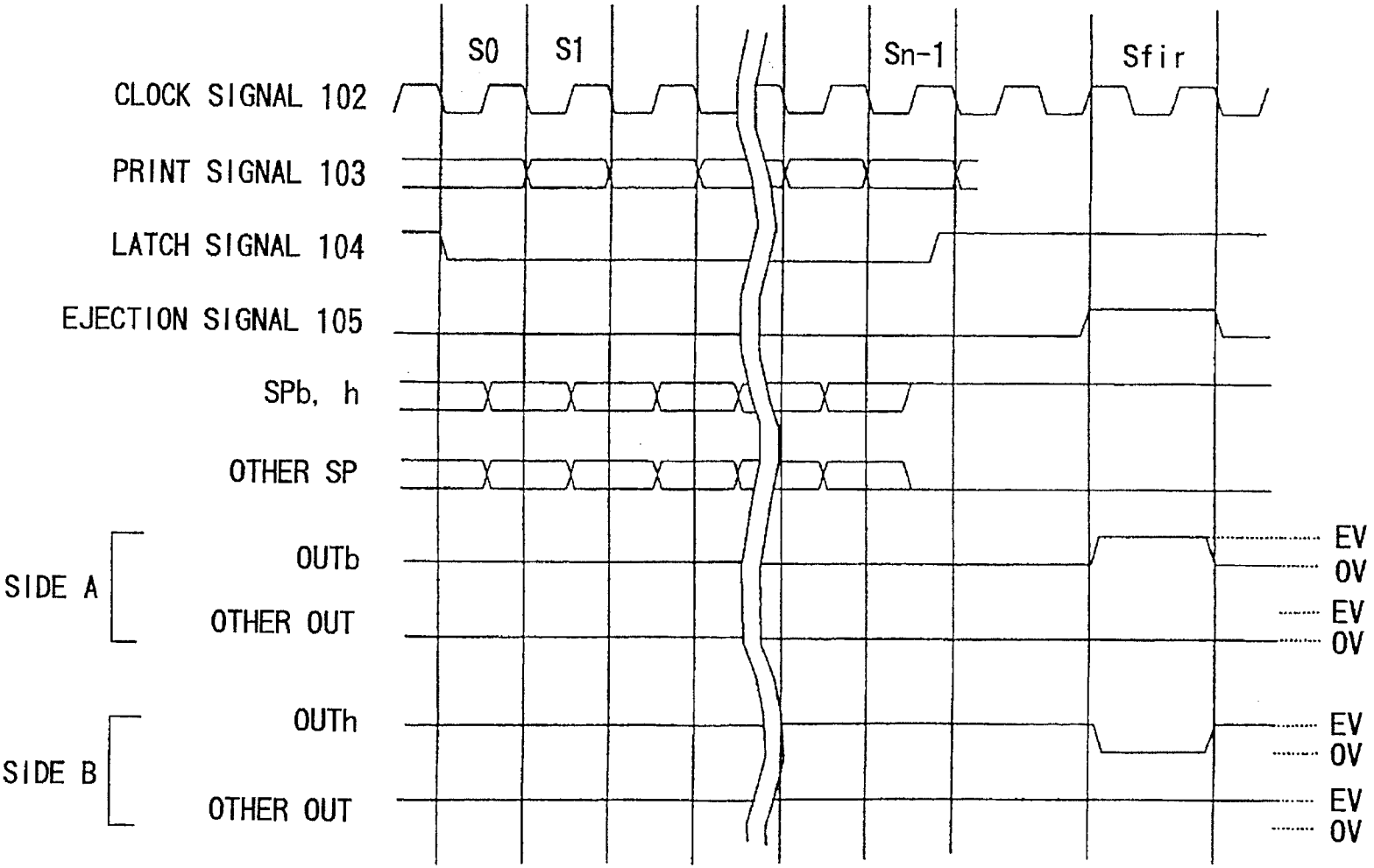
FIG. 8 is a timing chart indicating operation of the driving device of the embodiment.
Figure 10:
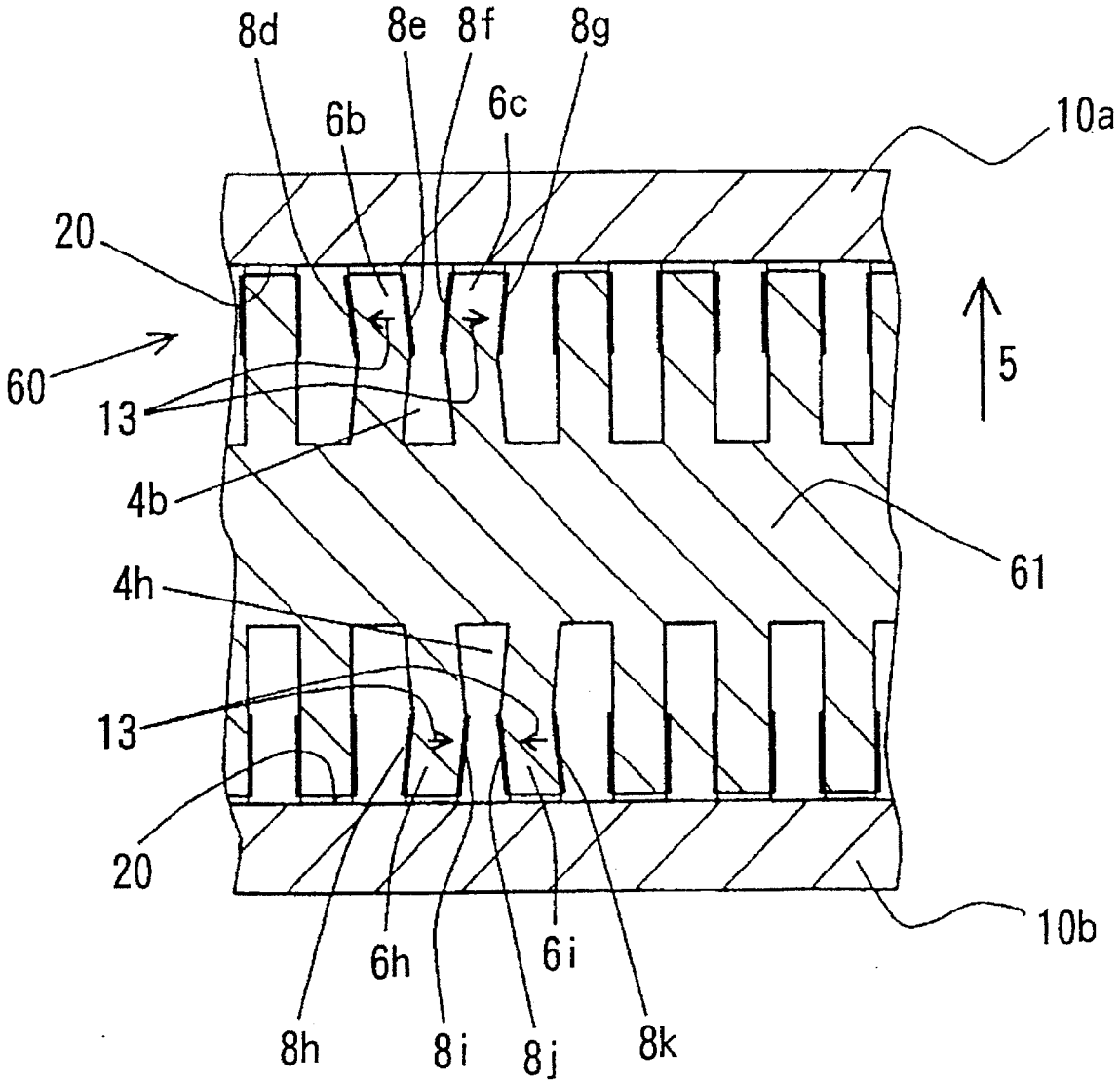
FIG. 10 is an explanatory diagram showing operation of the ink jet head according to the embodiment.
Figure 11:
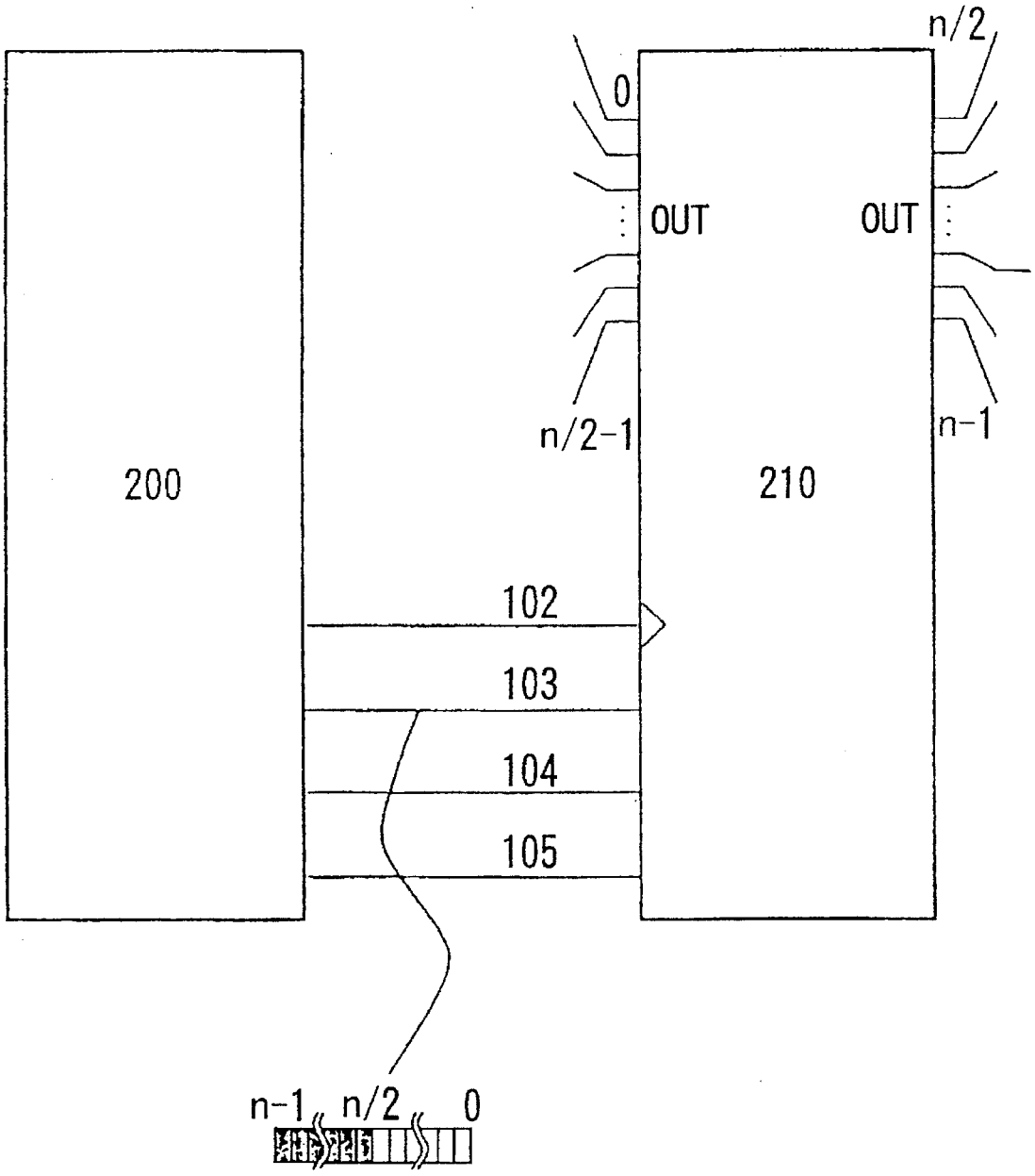
FIG. 11 is an explanatory diagram showing a driving device according to a second preferred embodiment of the present invention for driving an ink jet head.

Next, an description of operation of the present invention will be provided while referring to FIG. 10 and the timing chart in FIG. 8.

A description will be provided for the situation when ink droplets are ejected simultaneously from chamber **4*b* of side A and from ink chamber 4*h* of side B. The following operations are performed for latching data for n number of channels in the driver 100. A "0" latch signal 104 is inputted to the S/P converter 106. At this same time a print signal 103 including data SO through Sn−1 is inputted to the S/P converter 106 in synchronization with the clock signal 102. After a number of clock pulses, a value of "1" (which represents a command for ejection of ink) is at the outputs of the S/P converter 106 for channels SPb and SPh, that is, the ouputs connected to ink chamber 4*b* and ink chamber 4*h*. A value of "0" is at the outputs of the S/P converter 106 for other channels. When transmission is completed, a "1" latch signal for latching the transmitted data is inputted to the S/P convertor 106** (Sn−1) from a controller (not shown).

The ejection signal 105 is "1" when ink is to be ejected and "0" at all other times. AND gates 107 that are inputted with a "0" ejection signal 105 therefore output "0" signals regardless of the output from the S/P convertor 106. That is, normally a "0" signal is transmitted to buffer ANDs 108 at channels 0 through n/2−1 and normally a "1" signal is transmitted to buffer ANDs 108 at channels n/2 through n−1. Buffer AND gates 108 output a 0 V voltage output OUT when inputted with a "0" signal. Buffer AND gates 108 output a voltage EV when inputted with a "1" signal. For this reason, buffer AND gates 108 at channels 0 through n/2−1 normally output OV and buffer gates 108 at channels n/2 through n−1 normally output a voltage EV.

When the ejection signal 105 is an enabling "1" the output from the AND gate 107 depends on the output SP from the S/P converter 105. That is, the output from the AND gates 107 at channel b and channel h is "1". All the other outputs are "0".

The output from the AND gate 107 at channels n/2 through n−1 for driving ink chambers of side B is inverted by the NOT gates 109 and outputted to respective AND buffers 108. Therefore, during ejection Sfir, input to the buffer AND gate 108 for channel b is "1". However, the input for the buffer AND gate 108 for channel h is the inverse of the output from the AND gate 107 and therefore "0". Also, with the exception of input for channels b and h, input to buffer AND gates 108 is "0" for channels 0 through n/2−1 of side A and "1" for channels n/2 through n−1 of side B.

Therefore, during ejection Sfir, a voltage EV is applied to the metal electrodes **8*e* and 8*f* formed in the ink chamber 4*b* of side A, and a 0 V voltage is applied to the other metal electrodes 8 of side A. A 0 V voltage is applied to metal electrodes 8*i* and 8*j* formed in the ink chamber 4*h* of side B and a voltage EV is applied to the other metal electrodes 8 of side B. This causes an electric field to form in side walls 6*b* and 6*c* and side walls 6*h* and 6*i* in directions indicated by arrows 13. Directions indicated by arrows 13 are perpendicular to the direction 5 of polarization. As shown in FIG. 10, the side walls 6*b* and 6*c* and side walls 6*h* and 6*i* rapidly deform inward by the shear effect of the piezoelectric ceramic plate. The volume of the ink chamber 4*b* of side A and ink chamber 4*h* of side B decreases. Ink droplets are consecutively ejected through nozzles 12 that are in communication with ink chambers 4*b* and 4*h*** at timing desired for printing.

In regards to metal electrodes 8 in ink chamber 4 of side A in the ink jet head 60, a voltage EV from power source 99 is applied to metal electrodes **8*e* and 8*f* formed in ink chamber 4*b* from which ink is to be ejected. Moreover, the metal electrodes 8 of other ink chambers 4, from which ink is not to be ejected, are connected to ground. The side walls 6*b* and 6*c* are deformed so that ink is ejected from ink chamber 4b. In regards to the metal electrode 8 of ink chambers 4 of side B, metal electrodes 8i and 8j of the ink chamber 4h, from which ink is to be ejected, are connected to ground. Moreover, a voltage EV from power source 99 is applied to metal electrodes of other ink chambers 4, from which ink is not to be ejected. Therefore, side walls 6h and 6i deformed so that ink is ejected from ink chamber 4h. For this reason, ink is ejected from ink chambers 4 of both the upper and the lower row. In this way, the high density ink jet head 60 can be easily driven with a single power source 99, the drive circuit for the ink jet head 60 is simple, and the ink jet head 60** can be produced at low cost.

Figure 12:
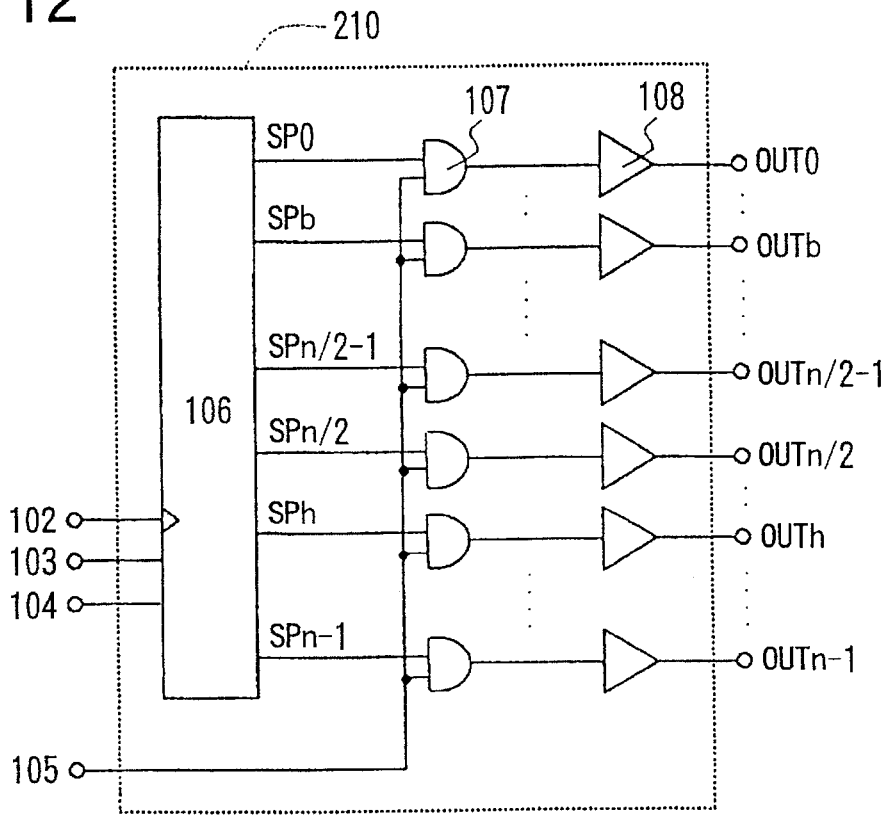
FIG. 12 is a structural diagram showing a driver of the driving device according to the second embodiment.

The present invention is not limited to the above-described example. Many variations are possible without departing from the essential scope of the present invention. For example, in the above-described embodiment, the print signal 103 applied to side B is inverted in the driver 100 by the NOT gate 109. However, the control section 200 for controlling the driver 210 could be provided to invert print signals n/2 through n−1 bits for side B before transmitting them to the driver 210. In this case, the NOT gates 109 shown in FIG. 5 would be unnecessary so that the internal structure of the driver would appear as in FIG. 12.

Figure 13:
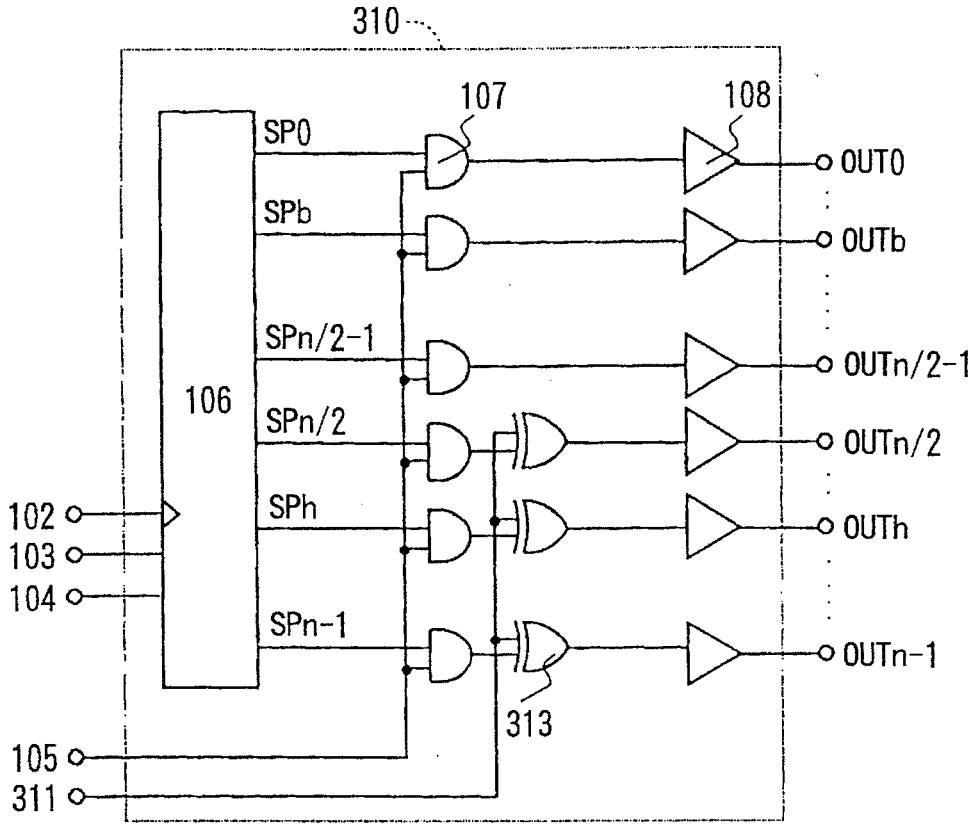
FIG. 13 is an explanatory diagram indicating a driving device according to a third preferred embodiment of the present invention for driving an ink jet printer.

Also, in the above-described embodiment, the print signal 103 applied to side B is inverted in the driver 100 by the NOT gate 109. However, exclusive OR (EX-OR) gates 313 could be provided between the AND gates 107 and the buffer AND gates 108 as shown in FIG. 13. In this situation, an inversion signal 311 is transmitted to the EX-OR 313. The inversion signal 311 is for sending a synchronized signal with the ejection signal 105. In this way, print signal n/2 through n−1 bits for side B are inverted only when ink is to be ejected. In this case, a "0" signal is normally transmitted to buffer AND gates 108 for channel 0 through n−1. Therefore, the buffer AND gates 108 for channels 0 through n−1 normally output a 0 V voltage. Only buffer AND gates of channels that receive an ejection signal of "1" output a voltage EV. Therefore, a voltage is applied to the side walls of side B only for a short period and the life of the head increases.

Incidentally, in the present embodiment of the present invention, ink is described as ejected by reducing the volume of the ink chamber 4 from a natural state. However, the volume of the ink chamber 4 could first be increased from a natural state and then returned to the natural state. The change in volume produced when the volume is returned to the natural state could be used to eject ink.

It will be clear from the above description that according to the present invention for a driving device for an ink jet print head, in regards to one side of an actuator section, a control means applies a voltage from a power source to electrodes of ink chambers from which ink is to be ejected, but does not apply a voltage to ink chambers from which ink is not to be ejected. The side walls deform so that ink is ejected from ink chambers from which ink is to be ejected. In regards to the other side of the actuator member, the control means applies a voltage from the power source to electrodes of all ink chambers from which ink is not to be ejected, but does not apply a voltage to ink chambers from which ink is to be ejected. The side walls deform so that ink is ejected from ink chambers from which ink is to be ejected. Therefore, a high density ink jet heat can be driven with a single power source, have a drive circuit with simple construction, and a low cost of production.

While only one exemplary embodiment of this invention has been described in detail, those skilled in the art will recognize that there are many possible modifications and variations which may be made in this exemplary embodiment while yet retaining many of the novel features and advantages of the invention. Accordingly, all such modifications and variations are intended to be included within the scope of the appended claims.

What is claimed is:

1. An ink jet head assembly, comprising:

an actuator formed from a piezoelectric material polarized in a direction, the actuator having a first surface, a second surface opposite the first surface, and a third surface perpendicular to both said first surface and said second surface, a plurality of partition walls being formed at equi-interval in each of said first surface and said second surface wherein each of said plurality of partition walls has two side surfaces opposite to each other and a top surface, a plurality of grooves being formed in each of said first surface and said second surface wherein each of said plurality of grooves is defined by two adjacent partition walls;

a plurality of first electrode pairs provided in one-to-one correspondence to said plurality of partition walls in said first surface, two electrodes of each of said first electrode pairs being attached respectively to two side surfaces of each of said plurality of partition walls;

a plurality of second electrode pairs provided in one-to-one correspondence to said plurality of partition walls in said second surface, two electrodes of each of said second electrode pairs being attached respectively to two side surfaces of each of said plurality of partition walls;

a first cover plate having a side facing the actuator, the side of the first cover plate facing the actuator being substantially flat, the top surface of each of said plurality of partition walls in said first surface being attached to the side of said first cover plate facing the actuator;

a second cover plate having a side facing the actuator, the side of the second cover plate facing the actuator being substantially flat, the top surface of each of said plurality of partition walls in said second surface being attached to the side of said second cover plate facing the actuator, ink channels being defined by each of said first cover plate and said second cover plate and each of said plurality of grooves in each of said first surface and said second surface, said ink channels being filled with ink;

a nozzle plate attached to said third surface of said actuator, said nozzle plate being formed with a plurality of nozzles in positions corresponding to the ink channels; and a driving device including a single power source, a plurality of first connecting means for connecting said single power source to said plurality of first electrode pairs, said plurality of first connecting means being provided in one-to-one correspondence to said plurality of first electrode pairs, a plurality of second connecting means for connecting said single power source to said plurality of second electrode pairs, said plurality of second connecting means being provided in one-to-one correspondence to said plurality of second electrode pairs, and control means for controlling said plurality of first connecting means to connect said single power source to selected ones of said plurality of first electrode pairs in said first surface and to disconnect said single power source from non-selected electrode pairs in said first surface, and for controlling said plurality of second connecting means to disconnect said single power source from selected ones of said plurality of second electrode pairs in said second surface and to connect said single power source to non-selected electrode pairs in said second surface, so that selected partition walls corresponding to said selected ones of said plurality of first electrode pairs in said first surface and said selected ones of said plurality of second electrode pairs in said second surface deform, thereby ejecting an ink droplet from each of said nozzles corresponding to the selected partition walls.

2. The ink jet head assembly according to claim 1, wherein each of said plurality of first connecting means comprises an AND gate having a first input, a second input and an output, the first input being selectively applied with a print signal, the second input being selectively applied with an ejection signal, corresponding electrode pair of said each of said plurality of first connecting means being connected to said single power source when said AND gate is enabled, and wherein each of said plurality of second connecting means comprises an AND gate having a first input, a second input and an output, the first input being selectively applied with a print signal, the second input being selectively applied with an ejection signal, and an invertor connected to the output of said AND gate of said second connecting means, corresponding electrode pair of said each of said plurality of second connecting means being connected to said single power source when said AND gate of said second connecting means is enabled.

3. The ink jet head assembly according to claim 2, wherein said each of said plurality of first connecting means further comprises a buffer amplifier connected to the output of said AND gate of said first connecting means, said buffer amplifier connecting the corresponding electrode pair of said each of said plurality of first connecting means to said power source when said AND gate of said first connecting means is enabled whereas connecting the corresponding electrode pair of said each of said plurality of first connecting means thereof to ground when said AND gate of said first connecting means is disabled, and wherein said each of said plurality of second connecting means further comprises a buffer amplifier connected to the output of said AND gate of said second connecting means, said buffer amplifier connecting corresponding electrode pair of said each of said plurality of second connecting means to said power source when said AND gate of said second connecting means is enabled whereas connecting the corresponding electrode pair of said each of said plurality of second connecting means thereof to ground when said AND gate of said second connecting means is disabled.

4. The ink jet assembly according to claim 1, wherein said each of said plurality of first connecting means comprises an AND gate having a first input, a second input and an output, the first input being selectively applied with a print signal, the second input being selectively applied with an ejection signal, corresponding electrode pair of said each of said plurality of first connecting means being connected to said single power source when said AND gate is enabled, and wherein said each of said plurality of second connecting means comprises an AND gate having a first input, a second input and an output, the first input being selectively applied with the print signal, the second input selectively applied with the ejection signal, and an exclusive OR gate having a first input, a second input and an output, the first input being connected to the output of said AND gate of said second connecting means, said second input of said exclusive OR being selectively applied with an inverted signal of the ejection signal applied to the second input of said AND gate of said second connecting means, corresponding electrode pair of said each of said plurality of second connecting means being connected to said single power source when said AND gate of said second connecting means and said exclusive OR gate are enabled.

5. The ink jet head assembly according to claim 4, wherein said each of said plurality of first connecting means further comprises a buffer amplifier connected to the output of said AND gate of said first connecting means, said buffer amplifier connecting the corresponding electrode pair of said each of said plurality of first connecting means to said single power source when said AND gate of said first connecting means is enabled whereas connecting the corresponding electrode pair thereof to ground when said AND gate of said first connecting means is disabled, and wherein said each of said plurality of second connecting means further comprises a buffer amplifier connected to the output of said exclusive OR gate, said buffer amplifier of said second connecting means connecting corresponding electrode pair of said each of said plurality of second connecting means to said power source when said AND gate of said second connecting means is enabled whereas connecting the corresponding electrode pair thereof to ground when said AND gate of said second connecting means is disabled.

6. The ink jet head assembly according to claim 1, wherein each of said plurality of first connecting means comprises an AND gate having a first input, a second input and an output, the first input being selectively applied with a print signal, the second input being selectively applied with an ejection signal, corresponding electrode pair of said each of said plurality of first connecting means being connected to said single power source when said AND gate is enabled, and wherein said control means comprises inverting means for inverting the print signal and outputting an inverted print signal, and wherein said each of said plurality of second connecting means comprises an AND gate having a first input, a second input and an output, the first input being selectively applied with the inverted print signal, the second input being selectively applied with the ejection signal, corresponding electrode pair of said each of said plurality of second connecting means being connected to said single power source when said AND gate of said second connecting means is enabled.

7. The ink jet head assembly according to claim 6, wherein said each of said plurality of first connecting means further comprises a buffer amplifier connected to the output of said AND gate of said first connecting means, said buffer amplifier connecting the corresponding electrode pair of said each of said plurality of first connecting means to said power source when said AND gate of said first connecting means is enabled whereas connecting the corresponding electrode pair thereof to ground when said AND gate of said first connecting means is disabled, and wherein said each of said plurality of second connecting means further comprises a buffer amplifier connected to the output of said AND gate of said second connecting means, said buffer amplifier connecting the corresponding electrode pair of said each of said plurality of second connecting means to said single power source when said AND gate of said second connecting means is enabled whereas connecting the corresponding electrode pair thereof to ground when said AND gate of said second connecting means is disabled.

8. The ink jet head assembly according to claim 1, wherein said plurality of partition walls in said first surface and said second surface are polarized in the same direction.

9. The ink jet head assembly according to claim 8, wherein said actuator is formed from a single layered piezoelectric material.

10. An ink jet head assembly, comprising:

an actuator formed from a piezoelectric material polarized in a direction, the actuator having a first surface, a second surface opposite the first surface, and a third surface perpendicular to both said first surface and said second surface, a plurality of partition walls being formed at equi-interval in each of said first surface and said second surface, said plurality of partition walls extending in a direction in which said piezoelectric material is polarized, wherein each of said plurality of partition walls has two side surfaces opposite to each other and a top surface, a plurality of grooves being formed in each of said first surface and said second surface, wherein each of said plurality of grooves is defined by two adjacent partition walls;

a plurality of first electrode pairs provided in one-to-one correspondence to said plurality of partition walls in said first surface, two electrodes of each of said first electrode pairs being attached respectively to two side surfaces of each of said plurality of partition walls to deform the partition wall;

a plurality of second electrode pairs provided in one-to-one correspondence to said plurality of partition walls in said second surface, two electrodes of each of said second electrode pairs being attached respectively to two side surfaces of each of said plurality of partition walls;

a first cover plate attached to the top surface of each of said plurality of partition walls in said first surface;

a second cover plate attached to the top surface of each of said plurality of partition walls in said second surface, ink channels being defined by each of said first cover plate and said second cover plate and each of said plurality of grooves in each of said first surface and said second surface, said ink channels being filled with ink;

a nozzle plate attached to said third surface of said actuator, said nozzle plate being formed with a plurality of nozzles in positions corresponding to the ink channels; and a driving device including a single power source for application of a predetermined voltage, a plurality of first connecting means for connecting said single power source to said plurality of first electrode pairs, said plurality of first connecting means being provided in one-to-one correspondence to said plurality of first electrode pairs, a plurality of second connecting means for connecting said single power source to said plurality of second electrode pairs, said plurality of second connecting means being provided in one-to-one correspondence to said plurality of second electrode pairs, and control means for controlling said plurality of first connecting means to connect said single power source to selected ones of said plurality of first electrode pairs in said first surface and to disconnect said single power source from non-selected electrode pairs in said first surface, and for controlling said plurality of second connecting means to disconnect said single power source from selected ones of said plurality of second electrode pairs in said second surface and to connect said single power source to non-selected electrode pairs in said second surface, so that selected partition walls corresponding to said selected ones of said plurality of first electrode pairs in said first surface and said selected ones of said plurality of second electrode pairs in said second surface deform depending upon the voltage application by said single power source, thereby ejecting an ink droplet from each of nozzles corresponding to the selected partition walls, wherein said first cover plate and said second cover plate are free from deformation dependent upon the voltage application by said single power source.

11. The ink jet head assembly according to claim 10, wherein said plurality of partition walls in said first surface and said second surface are polarized in the same direction.

12. The ink jet head assembly according to claim 11, wherein said actuator is formed from a single layered piezoelectric material.

13. The ink jet head assembly according to claim 10, wherein each of said plurality of first connecting means comprises an AND gate having a first input, a second input and an output, the first input being selectively applied with a print signal, the second input being selectively applied with an ejection signal, corresponding electrode pair of said each of said plurality of first connecting means being connected to said single power source when said AND gate is enabled, and wherein each of said plurality of second connecting means comprises an AND gate having a first input, a second input and an output, the first input being selectively applied with the print signal, the second input being selectively applied with the ejection signal, and an invertor connected to the output of said AND gate of said second connecting means, corresponding electrode pair of said each of said plurality of second connecting means being connected to said single power source when said AND gate of said second connecting means is enabled.

14. The ink jet head assembly according to claim 13, wherein said each of said plurality of first connecting means further comprises a buffer amplifier connected to the output of said AND gate of said first connecting means, said buffer amplifier connecting the corresponding electrode pair of said each of said plurality of first connecting means to said power source when said AND gate of said first connecting means is enabled whereas connecting the corresponding electrode pair of said each of said plurality of first connecting means thereof to ground when said AND gate of said first connecting means is disabled, and wherein said each of said plurality of second connecting means further comprises a buffer amplifier connected to the output of said AND gate of said second connecting means, said buffer amplifier connecting corresponding electrode pair of said each of said plurality of second connecting means to said power source when said AND gate of said second connecting means is enabled whereas connecting the corresponding electrode pair of said each of said plurality of second connecting means thereof to ground when said AND gate of said second connecting means is disabled.

15. The ink jet head assembly according to claim 10, wherein said each of said plurality of first connecting means comprises an AND gate having a first input, a second input and an output, the first input being selectively applied with a print signal, the second input being selectively applied with an ejection signal, corresponding electrode pair of said each of said plurality of first connecting means being connected to said single power source when said AND gate is enabled, and wherein said each of said plurality of second connecting means comprises an AND gate having a first input, a second input, and an output, the first input being selectively applied with the print signal, the second input being selectively applied with the ejection signal, and an exclusive OR gate having a first input, a second input and an output, the first input being connected to the output of said AND gate of said second connecting means, said second input of said exclusive OR being selectively applied with an inverted signal of the ejection signal applied to the second input of said AND gate of said second connecting means, corresponding electrode pair of said each of said plurality of second connecting means being connected to said single power source when said AND gate of said second connecting means and said exclusive OR gate are enabled.

16. The ink jet head assembly according to claim 15, wherein said each of said plurality of first connecting means further comprises a buffer amplifier connected to the output of said AND gate of said first connecting means, said buffer amplifier connecting the corresponding electrode pair of said each of said plurality of first connecting means to said single power source when said AND gate of said first connecting means is enabled whereas connecting the corresponding electrode pair thereof to ground when said AND gate of said first connecting means is disabled, and wherein said each of said plurality of second connecting means further comprises a buffer amplifier connected to the output of said exclusive OR gate, said buffer amplifier of said second connecting means connecting corresponding electrode pair of said each of said plurality of second connecting means to said power source when said AND gate of said second connecting means is enabled whereas connecting the corresponding electrode pair thereof to ground when said AND gate of said second connecting means is disabled.

17. The ink jet head assembly according to claim 10, wherein each of said plurality of first connecting means comprises an AND gate having a first input, a second input and an output, the first input being selectively applied with a print signal, the second input being selectively applied with an ejection signal, corresponding electrode pair of said each of said plurality of first connecting means being connected to said single power source when said AND gate is enabled, wherein said control means comprises inverting means for inverting the print signal and outputting an inverted print signal, and wherein said each of said plurality of second connecting means comprises an AND gate having a first input, a second input and an output, the first input being selectively applied with the inverted print signal, the second input being selectively applied with the ejection signal, corresponding electrode pair of said each of said plurality of second connecting means being connected to said single power source when said AND gate of said second connecting means is enabled.

18. The ink jet assembly according to claim 17, wherein said each of said plurality of first connecting means further comprises a buffer amplifier connected to the output of said AND gate of said first connecting means, said buffer amplifier connecting the corresponding electrode pair of said each of said plurality of first connecting means to said power source when said AND gate of said first connecting means is enabled whereas connecting the corresponding electrode pair thereof to ground when said AND gate of said first connecting means is disabled, and wherein said each of said plurality of second connecting means further comprises a buffer amplifier connected to the output of said AND gate of said second connecting means, said buffer amplifier connecting the corresponding electrode pair of said each of said plurality of second connecting means to said single power source when said AND gate of said second connecting means is enabled whereas connecting the corresponding electrode pair thereof to ground when said AND gate of said second connecting means is disabled.

* * * * *